US007536883B1

(12) United States Patent
Liu

(10) Patent No.: US 7,536,883 B1
(45) Date of Patent: May 26, 2009

(54) VANDAL-RESISTANT COMBINATION PADLOCK

(75) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 12/149,635

(22) Filed: May 6, 2008

(51) Int. Cl.
*E05B 37/02* (2006.01)

(52) U.S. Cl. ..... 70/25; 70/52; 70/312; 70/322

(58) Field of Classification Search ..... 70/22, 70/24–30, 51, 52, 312, 320–322
See application file for complete search history.

(56) References Cited

U.S. PATENT DOCUMENTS 1,964,936 A * 7/1934 Denerich ..... 70/25
2,853,868 A * 9/1958 Vahlstrom ..... 70/24
3,419,893 A * 12/1968 Vahlstrom ..... 70/24
3,817,063 A * 6/1974 Williams ..... 70/24
4,047,406 A * 9/1977 Foote ..... 70/25
6,012,309 A * 1/2000 Liu ..... 70/25
6,708,534 B1 * 3/2004 Ruan ..... 70/38 A
6,834,519 B1 * 12/2004 Yang ..... 70/58

* cited by examiner

*Primary Examiner*—Lloyd A Gall
(74) *Attorney, Agent, or Firm*—Rosenberg, Klein & Lee

(57) ABSTRACT

A vandal-resistant combination padlock includes a lock body, a core, a claw mount, a locking claw and an U-shaped locking shackle. The lock body has a cavity well for containing a core and shackle. The core has plural sets of numerical dial wheels and coupling tumbler cams as well as a claw mount together with a rocking claw inserted therein. The rocking claw has a latching lever, plural pawls, a blocking dog and a clipping spring. The claw mount has a pair of cantilevers with each shoulder, a ledge and plural dividing ribs extended downwardly for inserting between the adjacent numerical dial wheels. By of the claw mount, the rocking claw is enclosed therein, the numerical dial wheels are properly inserted by the dividing ribs and all the internal components are well protected to avoid damage from an external force or tool.

2 Claims, 7 Drawing Sheets

A-A

VANDAL-RESISTANT COMBINATION PADLOCK

FIELD OF THE INVENTION

The present invention relates to a "vandal-resistant combination padlock", particularly for one having structural feature to enclose all the internal components therein being well protected to avoid damage from external force or tool so that the safety effect of the locked condition for the padlock is significantly promoted.

BACKGROUND OF THE INVENTION

For effective improvement the safety of the padlock to further protect the rights and interests, most of the industrial businessmen eagerly endeavor the research and development in the structural improvement of the padlock resulting into the current combination padlock from the evolution of non-combination padlock in the early stages. Other than the common combination padlock, some patented combination padlock with features of anti-vandal trait and easiness of operation are presented to the public in succession.

Please refer to the FIGS. 1 and 2 for the perspective exploded view and the facade cross section view of the conventional padlock, which comprises a lock body 10, a core 20, a triangular pad 30, a locking claw 40 and an U-shaped locking shackle 50, wherein, said lock body 10, which configures a cavity well 101, has a pair of retaining holes 102 formed in the top surface and a pair of latching lumps 103 formed adjacent to the bottom section of the retaining holes 102;

said core 20, which located inside of the cavity well 101 with a pair of upper escutcheons 201 and a pair of lower escutcheons 202 attached thereon, has a shaft 203 and mating bushing collar 204 running through plural sets of numerical dial wheels 205 and coupling tumbler cams 206 in between straddled over the pair of lower escutcheons 202 as well as a triangular pad 30 and a rocking claw 40 inserted between the pair of upper escutcheon 201;

said triangular pad 30, which is inserted between the pair of upper escutcheon 201 in the core 20, serves as a supporting base for the locking claw 40 to enhance stability;

said rocking claw 40, which straddles over the pair of upper escutcheons 201 in the core 20 by its fulcrum arm 402 for rocking to and fro, has a latching lever 401 extended between the latching lumps 103 of the lock body 10, plural pawls 403 extended downwards to press over corresponding tumbler cams 206, a blocking dog 404 extended to act with the corresponding bushing collar 204 and a clipping spring 405 disposed at front side thereof; and said locking shackle 50, whose short arm and elongated arm are engaged in the pair of retaining holes 102 of the lock body 10, has a clasping indentation 501 created at each arm to catch with each corresponding latching lump 103, and an anchor terminal 503 being coiled with restoring spring 502 extended over the end of the elongated arm.

For operation to the "locked status" reflecting the discrepancy of the combination in numerical dial wheels 205 to the preset correct combination, the bulging curve of at least one tumbler cam 206 will push the corresponding pawl 403 of the rocking claw 40 outwardly (as shown in the FIG. 3) so that the pair of the latching lumps 103 are reactively stretched to latch in the pair of corresponding clasping indentations 501 of the locking shackle 50 owing to the latching lever 401 of the rocking claw 40 will be inwardly seesawed by the pawl 403 in between the pair of the latching lumps 103.

Conversely, for operation to the "unlocked status" reflecting the consistence of the combination in numerical dial wheels 205 with the preset correct combination, the planar face of all tumbler cams 206 will retracted the corresponding pawl 403 of the rocking claw 40 inwardly by the clipping spring 405 (as shown in the FIG. 4) so that the pair of the latching lumps 103 are reactively released to free from the pair of corresponding clasping indentations 501 of the locking shackle 50 owing to the latching lever 401 of the rocking claw 40 will be outwardly seesawed by the pawl 403 out of the pair of the latching lumps 103; thus, the locking shackle 50 is freed to slide away the retaining holes 102 of the lock body 10 by the rebound of restoring spring 502.

For operation to alter the correct combination reset, it should be performed under the unlocked status for the conventional padlock that namely the anchor terminal 503 of the locking shackle 50 should not block the bushing collar 204 and the blocking dog 404 of the rocking claw 40 should not intervene between the bushing collar 204 and lower escutcheon 202. However, the redundant description will be neglected here as this beyond the scope of the disclosure for the present invention. Basing on the description heretofore together with the experimental observation, the rocking claw 40 of the conventional padlock has critical instable drawback because it simply straddles over the upper escutcheons 201 by its fulcrum arm 402 though being further supported by the triangular pad 30.

Moreover, the locked status and unlocked status of the conventional padlock depends on the rocking status of the rocking claw 40. In other words, the padlock is in unlocked status as long as the latching lever 401 of the rocking claw 40 does not locate between the latching lumps 103. Accordingly, the vandal people can easily unlock the conventional padlock via studying in know-how of releasing or breaking the latching lever 401 from the latching lumps 103 without knowledge of the correct combination preset. From practical observation on the phenomenon aforesaid for many years, two popular vandal methods adopted are that forcefully pry and ruin the rocking claw 40 by inserting the tapering flat tool into the gap between the adjacent numerical dial wheels 205, or forcefully loose and fall apart the rocking claw 40 by directly beating the numerical dial wheels 205 with hammer or the like. That is the safety drawback of the conventional padlock need to be improved. Realizing and addressing these facts and drawbacks mentioned above for the conventional padlock, the applicant is eager to improve and solve these issues. Through hard research and development as well as test and improvement, eventually, the present invention is successful developed.

SUMMARY OF THE INVENTION

Accordingly, the object of the present invention is to provide a "vandal-resistant combination padlock" with feature that all the internal components in padlock are well protected to avoid from vandal unlocked manner suffered damage from external force or tool so that the safety effect of the locked condition for the padlock is significantly promoted.

For achieving the object mentioned above, the "vandal-resistant combination padlock" of the present invention comprises a lock body, a core, a claw mount, a locking claw and an U-shaped locking shackle, wherein, said lock body, which configures a cavity well, has a pair of retaining holes formed in the top surface and a pair of latching lumps formed adjacent to the bottom section of the retaining holes;

said core, which located inside of the cavity well with a pair of upper escutcheons and a pair of lower escutcheons attached thereon, has a shaft and mating bushing collar running through plural sets of numerical dial wheels and coupling tumbler cams in between straddled over the pair of lower escutcheons and a claw mount together with a rocking claw inserted between the pair of upper escutcheons;

said rocking claw, which straddles over the pair of upper escutcheons in the core by its fulcrum arm for rocking to and fro, has a latching lever extended between the latching lumps of the lock body, plural pawls extended downwards to press over corresponding tumbler cams, a blocking dog extended to act with the corresponding bushing collar and a clipping spring disposed at front side thereof; and said locking shackle, whose short arm and elongated arm are engaged in the pair of retaining holes of the lock body, has a clasping indentation created at each arm to catch with each corresponding latching lump, and an anchor terminal being coiled with restoring spring extended over the end of the elongated arm;

The feature is that said claw mount, which is an integral lump inserted between the pair of upper escutcheon in the core and located over the numerical dial wheels to serve as a mounting base for the locking claw, has a pair of cantilevers with each shoulder being fixed on the upper escutcheons juxtaposed laterally so that the locking claw erected between the cantilevers and ledge of the claw mount, said claw mount has a ledge extended downwardly at the front end, and plural dividing ribs extended downwardly for inserting between the adjacent numerical dial wheels.

For the "vandal-resistant combination padlock" aforesaid, wherein, a bore punched on the backside plate of the core and a corresponding hole punched on the rear side of the claw mount for being fixed together by a screw. From the disclosure above for the "vandal-resistant combination padlock" of the present invention, by setting claw mount in the core and attaching the ledge of the claw mount with the inner side of the lock body, the rocking claw is enclosed in the claw mount by the cantilevers and ledge as well as all the adjacent numerical dial wheels are inserted by the dividing ribs of the claw mount in between to avoid damage from external force or tool so that the safety effect of the locked condition for the padlock is significantly promoted.

DETAILED DESCRIPTION OF THE PREFERRED EMBODIMENT

For the technological means by the applicant of the present invention, an exemplary preferred embodiment in association with the relevant drawings is disclosed in the detailed description below for expediting your better understanding and recognition.

Figure 1:
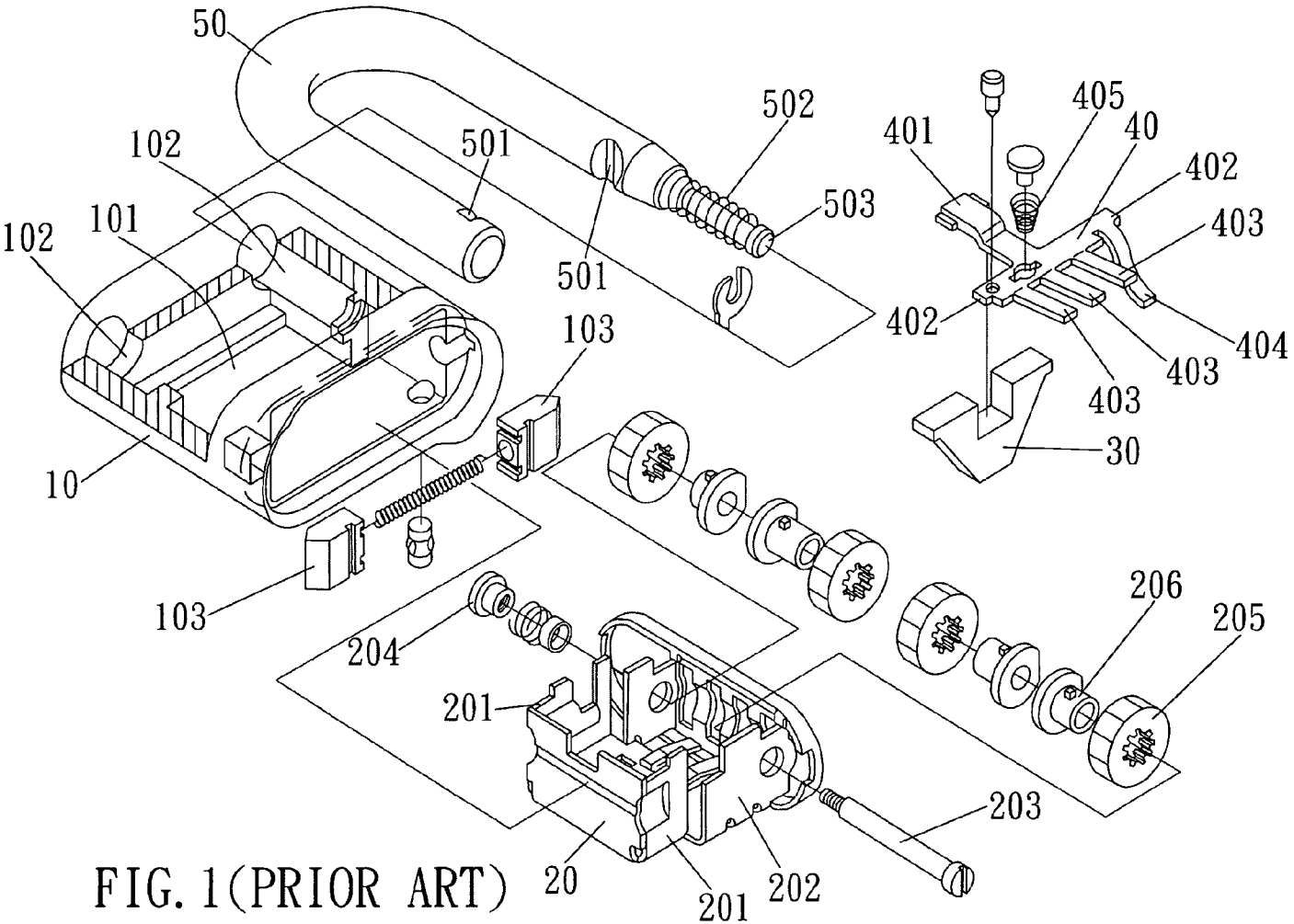
FIG. 1(PRIOR ART)
FIG. 1 is the perspective exploded view of the conventional padlock.
Figure 2:
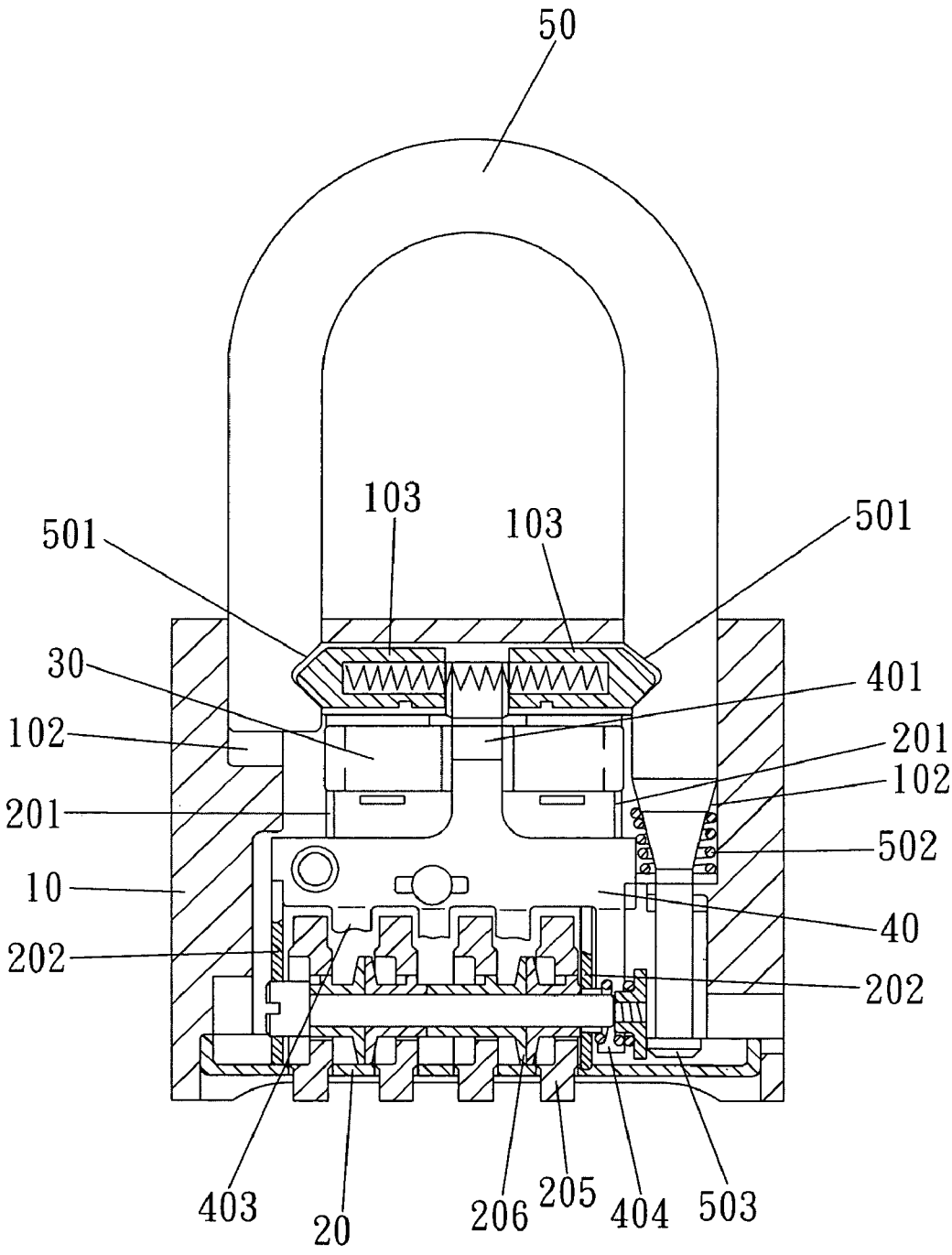
FIG. 2(PRIOR ART)
FIG. 2 is the facade cross section view of the conventional padlock.
Figure 4:
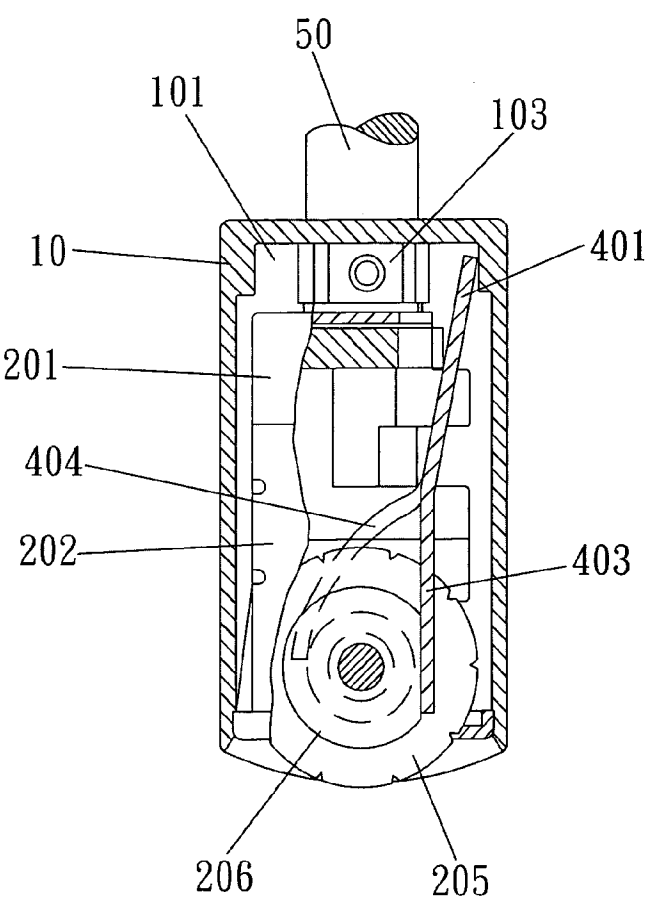
FIG. 4(PRIOR ART)
FIG. 4 is the second operation view showing the unlocked status of the conventional padlock.
Figure 3:
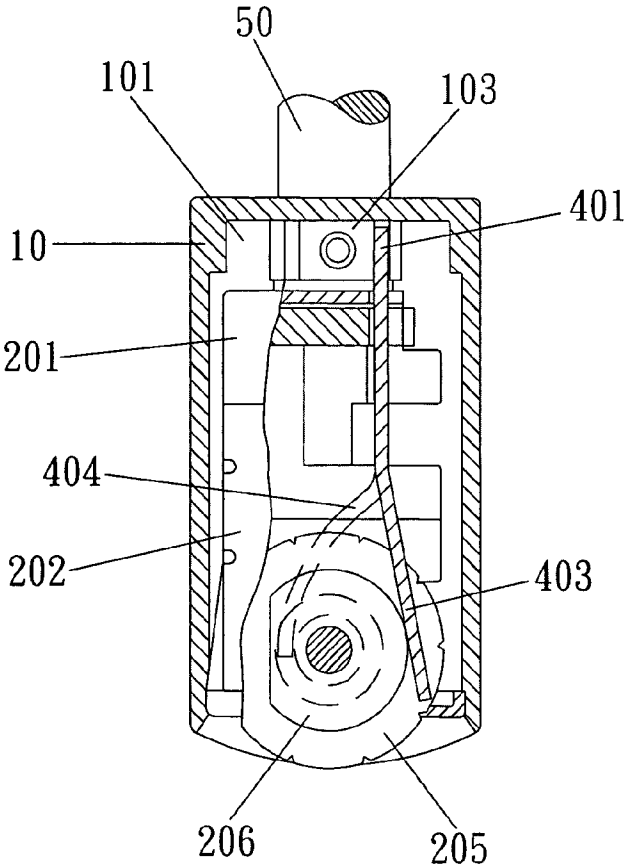
FIG. 3(PRIOR ART)
FIG. 3 is the first operation view showing the locked status of the conventional padlock.
Figure 5:
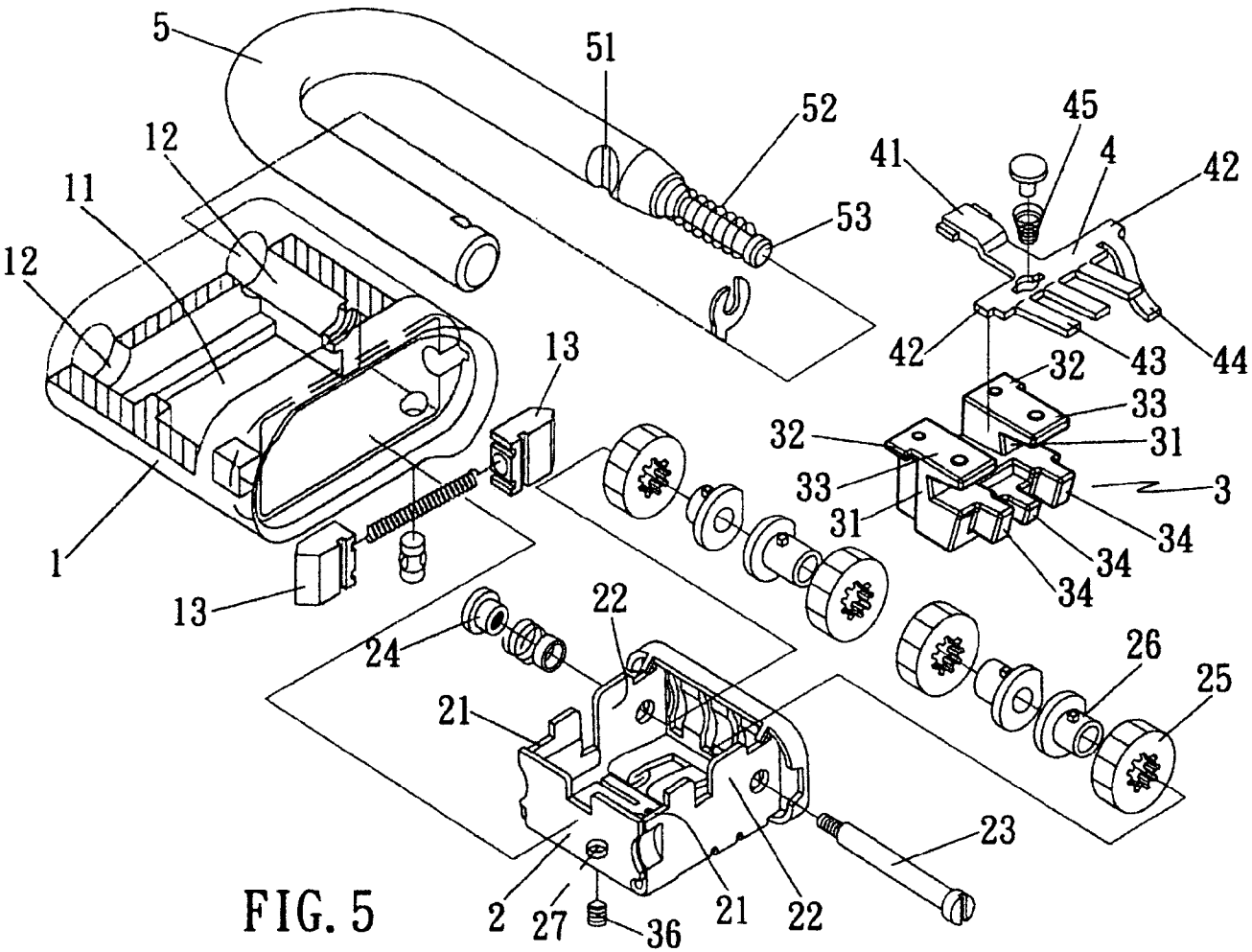
FIG. 5 is the perspective exploded view for the padlock of the present invention.
Figure 6:
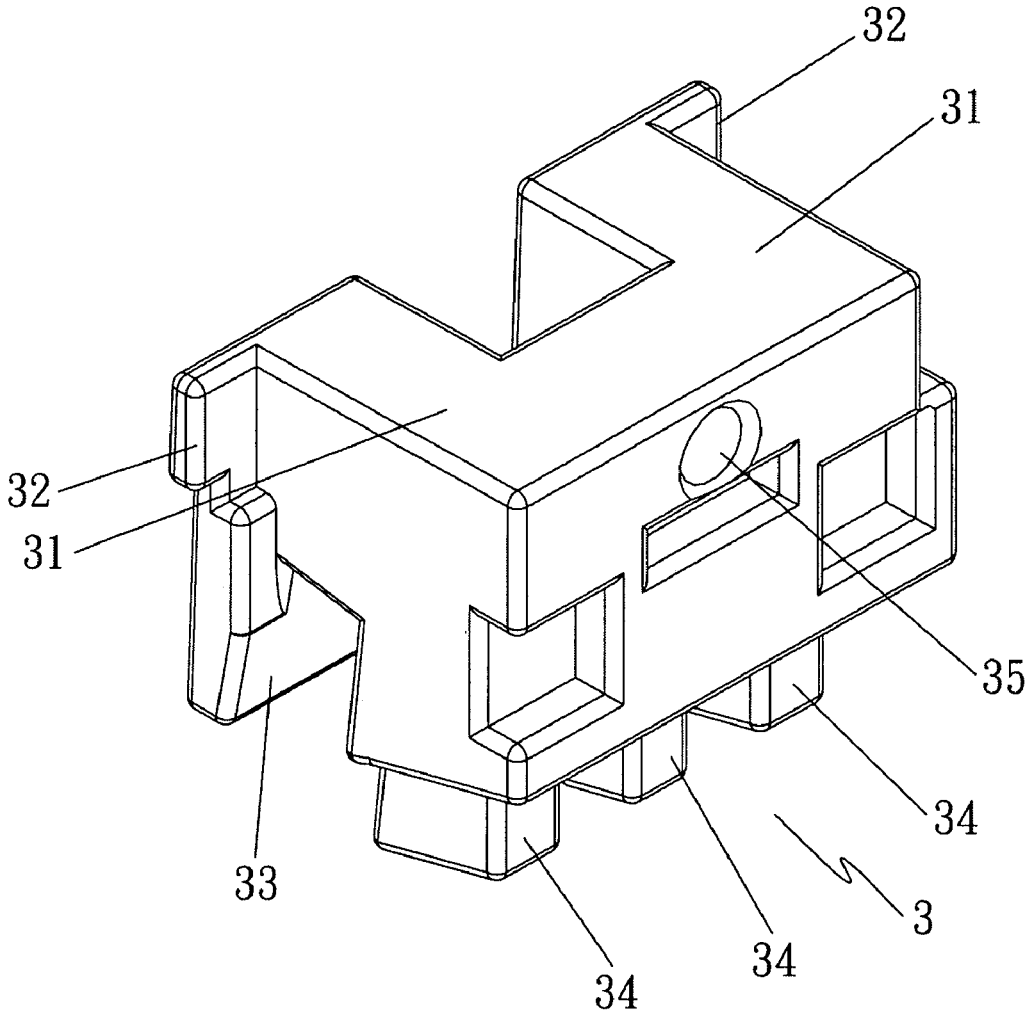
FIG. 6 is the perspective view from another view angle for the claw mount in the padlock of the present invention.

Please firstly refer to the FIGS. 5 and 6. The "vandal-resistant combination padlock" of the present invention comprises a lock body 1, a core 2, a claw mount 3, a locking claw 4 and an U-shaped locking shackle 5, wherein, said lock body 1, which configures a cavity well 11 as shown in FIG. 5, has a pair of retaining holes 12 formed in the top surface and a pair of latching lumps 13 formed adjacent to the bottom section of the retaining holes 12;

said core 2, which located inside of the cavity well 11 with a pair of upper escutcheons 21 and a pair of lower escutcheons 22 attached thereon as shown in FIG. 5, has a shaft 23 and mating bushing collar 24 running through plural sets of numerical dial wheels 25 and coupling tumbler cams 26 in between straddled over the pair of lower escutcheons 22 and a claw mount 3 together with a rocking claw 4 inserted between the pair of upper escutcheons 21;

said claw mount 3, is inserted between the pair of upper escutcheons 21 in the core 2 and is located over the numerical dial wheels 25 to serve as a mounting base for the locking claw 4, has a pair of cantilevers 31 with each shoulder 32 being fixed on the upper escutcheons 21 juxtaposed laterally, a ledge 33 extended downwardly at the front end, and plural dividing ribs 34 extended downwardly for inserting between the adjacent numerical dial wheels 25;

said rocking claw 4, which straddles over the pair of upper escutcheons 21 in the core 2 by its fulcrum arm 42 for rocking to and fro, has a latching lever 41 extended between the latching lumps 13 of the lock body 1, plural pawls 43 extended downwards to press over corresponding tumbler cams 26, a blocking dog 44 extended to act with the corresponding bushing collar 24 and a clipping spring 45 disposed at front side thereof;

Besides, a bore 27 punched on the backside plate of the core 2 and a corresponding hole 35 punched on the rear side of the claw mount 3 (as shown in the FIG. 6) for being fixed together by a screw 36; and said locking shackle 5, whose short arm and elongated arm are engaged in the pair of retaining holes 12 of the lock body 1 as shown in FIG. 5, has a clasping indentation 51 created at each arm to catch with each corresponding latching lump 13, and an anchor terminal 53 being coiled with restoring spring 52 extended over the end of the elongated arm.

Figure 7:
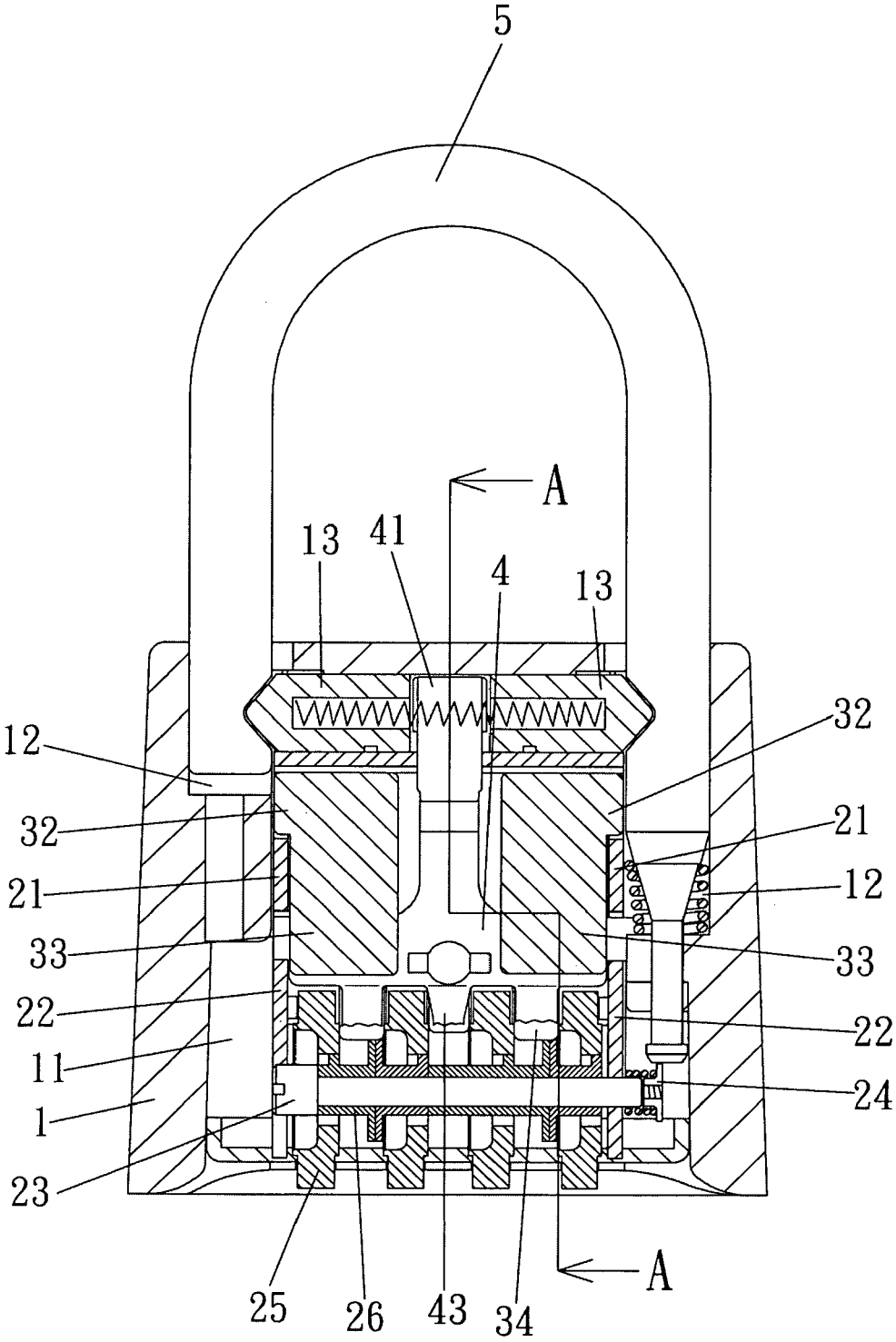
FIG. 7 is the facade cross section view for the padlock of the present invention.
Figure 8:
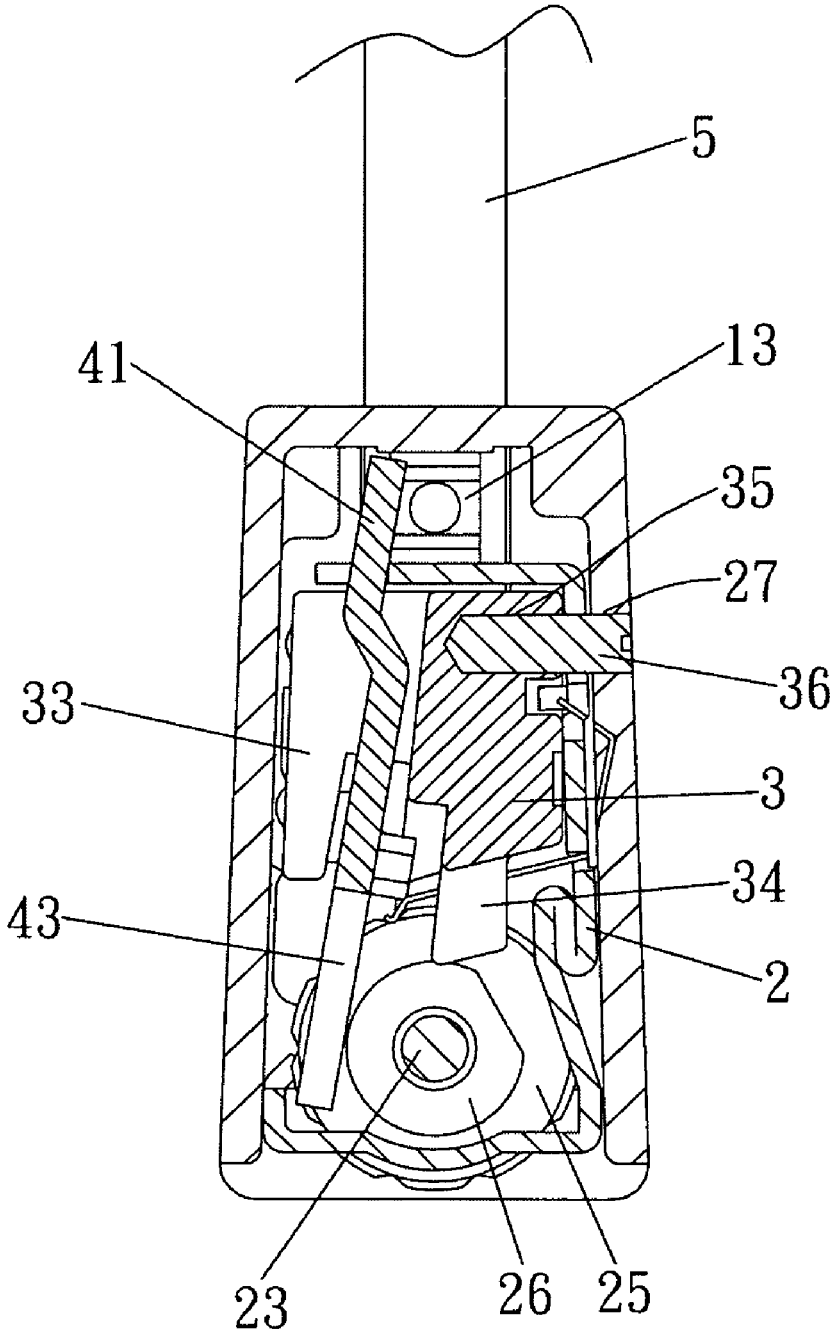
FIG. 8 is the cross section view taken along the line A-A from the FIG. 7.

Regarding the assembly procedure for the "vandal-resistant combination padlock" of the present invention, please refer to the FIGS. 7 and 8.

Firstly, run the shaft 23 and mating bushing collar 24 through plural sets of numerical dial wheels 25 and coupling tumbler cams 26 in between and straddle over the pair of lower escutcheons 22;

Secondly, insert the claw mount 3 between the pair of upper escutcheons 21 in the core 2 and fix it with screw 36 so that the shoulders 32 are fixed on the upper escutcheons 21 and let the claw mount 3 lay over the numerical dial wheels 25 and coupling tumbler cam 26 as well as let plural dividing ribs 34 insert between the adjacent numerical dial wheels 25 respectively to serve as adequate separation and position;

Thirdly, erect the rocking claw 4 between the cantilevers 31 and the ledge 33 on the claw mount 3 such that the latching lever 41 of the rocking claw 4 extended out the center of cantilevers 31 thereof;

Finally, contain all the components aforesaid into the cavity well 11 of the lock body 1 so that the ledge 33 of the claw mount 3 closely attaches the inner side of the lock body 1 as a supporting mean and the latching lever 41 of the rocking claw 4 configures between the latching lumps 13 in latched manner as shown in the FIG. 7.

From the disclosure above for the "vandal-resistant combination padlock" of the present invention, the integral strength of the core 2 is reinforced by the special design of the claw mount 3 in filling the extra internal space of the core 2 as well as the entire strength of the lock body 1 is enhanced by closely attaching the ledge 33 of the claw mount 3 with the inner side of the lock body 1. Moreover, the rocking claw 4 is prevented from damage of the external force because it is enclosed in the claw mount 3 by the cantilevers 31 and ledge 33. Furthermore, all the adjacent numerical dial wheels 25 are inserted by the dividing ribs 34 of the claw mount 3 in between to enhance protection. By these means, all the internal components in the "vandal-resistant combination padlock" of the present invention are well protected to avoid from vandal unlocked manner suffered damage from external force or tool so that the safety effect of the locked condition for the padlock is significantly promoted.

In conclusion from above disclosure, the "vandal-resistant combination padlock" of the present invention certainly overcomes and solves the issues and drawbacks mentioned before that it has industrial practical usage and improvement with expected feature and effect as well as has novelty in structure and non-obviousness beyond prior arts, which meets the essential criterion of patentability. Therefore, we submit the patent application in accordance with the related patent laws for your perusal with expectation of being granted for patent application, which will be greatly appreciated by us. All the disclosure heretofore is only the exemplary preferred embodiments of the present invention, which is not intended for limiting the range of the embodiment and claim. Any equivalent alteration and modification, which does not depart from the nature and essence of the present invention, should be reckoned as within the range and scope of the claims by the present invention.

What is claimed is:

1. A vandal-resistant combination padlock comprises a lock body, a core, a claw mount, a rocking claw and a U-shaped locking shackle, said lock body having a cavity well and a pair of retaining holes formed in the top surface and a pair of latching lumps formed adjacent to the bottom section of the retaining holes;

said core being located inside of the cavity well with a pair of upper escutcheons and a pair of lower escutcheons attached thereon, said core having a shaft and a mating bushing collar running through plural pairs of numerical dial wheels with associated tumbler cams in between respective pairs of numerical dial wheels, said shaft being straddled over the pair of lower escutcheons and said claw mount together with said rocking claw being inserted between the pair of upper escutcheons;

said rocking claw being straddled over the pair of upper escutcheons in the core by a fulcrum arm for rocking to and fro, said rocking claw having a latching lever extended between the latching lumps of the lock body, plural pawls extended downwards to press over corresponding tumbler cams, a blocking dog extended to act with a corresponding bushing collar and a clipping spring disposed at a front side thereof; and said locking shackle having a short arm and an elongated arm respectively engaged in the pair of retaining holes of the lock body, said locking shackle having a clasping indentation formed in each arm to respectively catch with a corresponding one of said latching lumps, said elongated arm having an anchor terminal and a restoring spring extended over an end thereof;

wherein said claw mount located over the numerical dial wheels to serve as a mounting base for the rocking claw, said claw mount having a ledge extended downwardly at a front end and thereof a pair of shoulders on opposing sides of said claw mount, said claw mount having a pair of cantilevers with each shoulder being fixed on the upper escutcheons so that the rocking claw is positioned between the cantilevers and said ledge of the claw mount, said claw mount having plural dividing ribs extended downwardly for insertion between the adjacent numerical dial wheels.

2. The vandal-resistant combination padlock as recited in claim 1, wherein, said core has a bore formed through a backside plate thereof and said claw mount has a corresponding hole formed through a rear side thereof for being fixed together by a screw.

* * * * *